US007111617B2

(12) United States Patent
Dilley et al.

(10) Patent No.: US 7,111,617 B2
(45) Date of Patent: Sep. 26, 2006

(54) DIVERTER FOR EXHAUST GAS RECIRCULATION COOLER

(75) Inventors: Roland L. Dilley, Lomita, CA (US); John T. Morris, Tempe, AZ (US); John F. Thurston, Mesa, AZ (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/994,566

(22) Filed: Nov. 22, 2004

(65) Prior Publication Data

US 2006/0107933 A1 May 25, 2006

(51) Int. Cl.
*F02B 47/08* (2006.01)
*F02B 47/00* (2006.01)

(52) U.S. Cl. ..... 123/568.18; 123/547

(58) Field of Classification Search ..... 123/568.18, 123/568.17, 568.12, 568.11, 547, 545, 546
See application file for complete search history.

(56) References Cited

U.S. PATENT DOCUMENTS 4,155,339 A 5/1979 Geiger et al.
4,426,848 A * 1/1984 Stachowicz ..... 60/605.2
5,425,239 A * 6/1995 Gobert ..... 60/605.2
5,611,203 A * 3/1997 Henderson et al. ..... 60/605.2
5,617,726 A * 4/1997 Sheridan et al. ..... 60/605.2
6,141,961 A 11/2000 Rinckel
6,408,833 B1 * 6/2002 Faletti ..... 123/568.17
6,444,345 B1 * 9/2002 Sang ..... 429/34
2004/0006978 A1 * 1/2004 Beck et al. ..... 60/289

FOREIGN PATENT DOCUMENTS

EP 1273786 A2 1/2003
WO PCT/US2005/042078 3/2006

* cited by examiner

*Primary Examiner*—Mahmoud Gimie
(74) *Attorney, Agent, or Firm*—Chris James

(57) ABSTRACT

A diverter, apparatus and method of bypassing an exhaust gas recirculation cooler in order to selectively cool recirculated exhaust gas is disclosed. The diverter relies on the Coanda effect to direct the exhaust gas flow to the cooler or to a bypass around the cooler and thus preferred embodiments do not require a valve to be provided in the exhaust gas flow for this purpose. This simplifies the assembly of the diverter and apparatus and provides for a more reliable diverter compared to certain known systems.

11 Claims, 2 Drawing Sheets

DIVERTER FOR EXHAUST GAS RECIRCULATION COOLER

FIELD OF THE INVENTION

The present invention relates to a diverter for an exhaust gas recirculation (EGR) loop, an apparatus comprising a diverter and an exhaust gas recirculation cooler, and a method for diverting flow in an exhaust gas recirculation (EGR) loop.

BACKGROUND OF THE INVENTION

Emissions regulations are requiring reduced emissions from vehicles, particularly the Euro 5, Bin 5 and US 06 regulations. To reduce harmful emissions, such as NOx, it is known to recirculate exhaust gas through the engine. Under normal conditions the exhaust gas is cooled before recirculation and it is known to pass the exhaust gas through an exhaust gas recirculation cooler. However, under "cold start" or low operating conditions, the gas can be over-cooled resulting in increased hydrocarbon emission and $CO_2$ production.

It is known from various publications to provide a valve and a bypass to bypass the cooler or alternatively direct the exhaust through a portion of the heat exchanger in which the heat transfer is minimal.

This avoids cooling the exhaust gas during such low operating conditions.

British Patent No 2,303,177 discloses an EGR system in which a portion of the exhaust gases produced by an engine are recirculated from an exhaust line of the engine into an intake line of the engine. In this system a cooler is arranged to cool the recirculated portion of the exhaust gases, and a bypass line is arranged to bypass the cooler. U.S. Pat. No. 6,141,961 discloses a further EGR loop with bypass.

In these systems, a valve selectively directs the flow of exhaust to either the exhaust gas recirculation cooler or to the bypass around the exhaust gas recirculation cooler. The valve requires good high-temperature compatibility, corrosion resistance, and resistance to plugging or sticking due to soot and other contaminants in the exhaust gas; all whilst remaining cost effective.

Whilst generally satisfactory, the prior art suffers from problems associated with plugging and sticking of the valves and the high specification required for the valves increases their cost.

An object of the present invention is to eliminate or mitigate any of the problems associated with the prior art.

SUMMARY OF THE INVENTION

According to a first aspect of the invention, there is provided a diverter for an exhaust gas recirculation loop, the diverter comprising a flow passage and at least one control line, the flow passage comprising:

- an exhaust gas inlet connectable to an exhaust gas outlet of an engine;
- a first outlet connectable to a cooling portion of an exhaust gas recirculation cooler;
- a second outlet connectable to a bypass around said cooling portion of an exhaust gas recirculation cooler; and,
- an expansion space;

wherein the at least one control line is adapted for fluid communication with the flow passage in order to selectively direct a higher proportion of exhaust gas into one of the said two outlets.

The control line is adapted such that it can be manipulated to change the direction of flow of the exhaust gas such that the higher proportion of exhaust gas can flow through either one of the said two outlets, as required.

Optionally the control line is adapted to direct gas into the flow passage so as to divert the flow of exhaust gas such that a higher proportion of exhaust gas flows into one of the said two outlets.

Alternatively the control line can be adapted to cause a pressure drop in the flow passage so as to divert the flow of exhaust gas such that a higher proportion of exhaust gas flows into one of the said two outlets.

Preferably the control line is adapted to selectively cause substantially all of the exhaust gas to proceed through one of the said two outlets and not through the other.

Optionally the control line is connectable to a turbocharger. One alternative is a for the control line to be connectable to a gas compressor.

The flow passage can comprise a constriction. If the flow passage comprises a constriction, preferably the constriction is provided upstream of the expansion space, more preferably immediately upstream of the expansion space.

The first and second outlets may be arranged symmetrically so that the exhaust gas flow in use, putting aside the affect of the control line(s), is not biased to preferentially flow through one of the first or second outlet.

Alternatively the first and second outlets may be arranged asymmetrically so that the exhaust gas flow in use, putting aside the affect of the control line(s), is biased to preferentially flow through one of the two outlets.

The at least one control line can comprise a valve, such as a solenoid valve.

There may be two control lines. If there are two control lines, preferably they are provided on opposite sides of the flow passage.

Preferably the angle between the main axis of the first outlet and the main axis of the second outlet is less than 90°.

According to a second aspect of the present invention, there is provided an exhaust gas recirculation cooler and bypass apparatus comprising:

- an exhaust gas recirculation cooler having a cooling portion;
- a bypass around said cooling portion of the exhaust gas recirculation cooler;
- a diverter comprising a flow passage and at least one control line;
- said flow passage comprising an exhaust gas inlet and an expansion space, the flow passage communicating with the said cooling portion and said bypass, wherein the at least one control line is adapted for fluid communication with the flow passage in order to selectively direct a higher proportion of the exhaust gas to one of the said cooling portion and bypass.

The apparatus according to the second aspect of the invention preferably comprises the diverter according to the first aspect of the invention.

The bypass may include a restriction, which is typically adapted to equalize the flow rate through the bypass with the flow rate through the cooling portion of the exhaust gas recirculation cooler.

The bypass may be a separate component to the exhaust gas recirculation cooler or may be a passage within the cooler adapted to minimize the cooling afforded to the exhaust gas flowing therethrough. However, particularly in the latter case, a small amount of cooling in the bypass may nonetheless occur.

Optionally, the apparatus comprises a turbocharger, and the turbocharger is connected to the at least one control line so that in use, it supplies air to the at least one control line.

Preferably the cooling portion of the exhaust gas recirculation cooler is adapted to cool the exhaust gas by use of a liquid coolant.

Typically the cooling portion of the exhaust gas recirculation cooler and bypass around said cooling portion each have an outlet which is connectable to an air inlet of an engine.

Thus the invention also provides an exhaust gas recirculation loop comprising the exhaust gas recirculation cooler and bypass apparatus according to the second aspect of the invention and an engine, said cooling portion and bypass each having an outlet; wherein the exhaust gas inlet of the said flow passage is connected to an exhaust gas outlet of said engine and the outlets of the cooling portion and bypass are connected to an air inlet of the engine.

A charge air/recirculated air mixer or other components may be provided between the outlets of the cooling portion/bypass and the inlet of the engine. According to a further aspect of the invention there is provided a method of bypassing an exhaust gas recirculation cooler, the method comprising:

(a) providing a diverter comprising a flow passage and at least one control line, the flow passage comprising:
   an exhaust gas inlet connected to an exhaust gas outlet of an engine;
   a first outlet connected to a cooling portion of an exhaust gas recirculation cooler;
   a second outlet connected to a bypass around said cooling portion of an exhaust gas recirculation cooler; and,
   an expansion space;
   the at least one control line being adapted for fluid communication with the flow passage;
(b) directing exhaust gas through the flow passage of the diverter and actuating the control line to selectively direct a higher proportion of exhaust gas into one of the said two outlets.

Preferably the method according to said further aspect of the invention uses the apparatus according to the second aspect of the invention.

Preferably the cooling portion and bypass around said cooling portion each have an outlet which is connected to an air inlet of an engine. Thus the invention can provide a method to cool the air prior to the air being fed into an engine.

Various components may interpose between said connection to the air inlet, for example, a fresh air/recirculated air mixer. Thus the method may include mixing the recirculated exhaust gas with fresh air or charged air received from a turbocharger.

The method may include manipulating the valves on the at least one control line in order to direct a higher proportion of the flow of the exhaust gas to one of the two outlets.

The control line may be pressurized so that gas is emitted when the valve is opened and the gas emitted directs the exhaust gas flow away from the control line. Alternatively the control line may be depressurized, so that opening of the valve causes a pressure drop and draws the exhaust gas flow to be drawn towards the control line.

The control line may emit a continuous stream of control gas to direct the exhaust gas flow. Alternatively the control line may emit pulses of control gas to divert the flow of the exhaust gas from one outlet to the other and a single pulse may be enough to direct the flow of exhaust gas from one outlet to the other.

BRIEF DESCRIPTION OF THE DRAWINGS

An embodiment of the present invention will now be described, by way of example only, with reference to the accompanying drawings, in which.

DETAILED DESCRIPTION OF PREFERRED EMBODIMENTS

Figure 1:
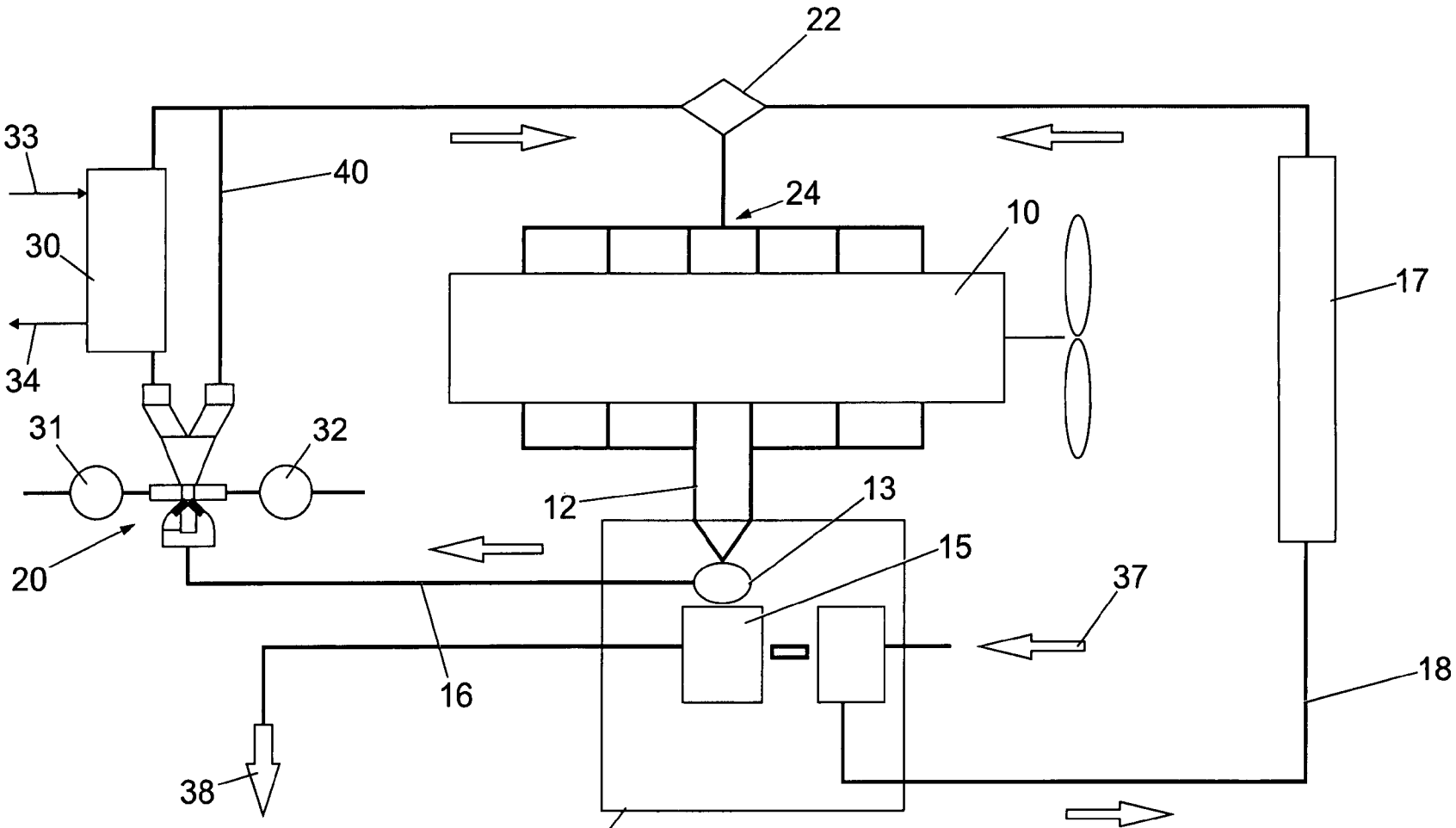
FIG. 1 is a schematic view of an exhaust gas recirculation loop around an internal combustion engine including a diverter in accordance with the present invention.

FIG. 1 shows an internal combustion engine 10 with an air intake 24 and exhaust line 12. A portion of the exhaust from the engine 10 is recirculated via a recirculation line 16, fluidic diverter 20, exhaust gas recirculation cooler 30 (EGC) and recirculated/charge air mixer 22 back to the engine air intake 24. A bypass 40 is provided for the recirculated exhaust gas to bypass the exhaust gas recirculation cooler 30 if no cooling of the exhaust gas is required, for example on low load operating conditions or on engine start up.

A flow control valve 13 determines the proportion of exhaust gas which is recirculated and the proportion which is emitted to the atmosphere via an exhaust 38.

A turbocharger 14 is powered by the exhaust gas by a variable nozzle turbine 15. Fresh air is drawn into the turbocharger 14 at inlet 37 which is compressed, and directed to the EGR charge air mixer 22 via a charge air cooler 17 and line 18 before proceeding to the air intake 24 of the engine 10.

Figure 2:
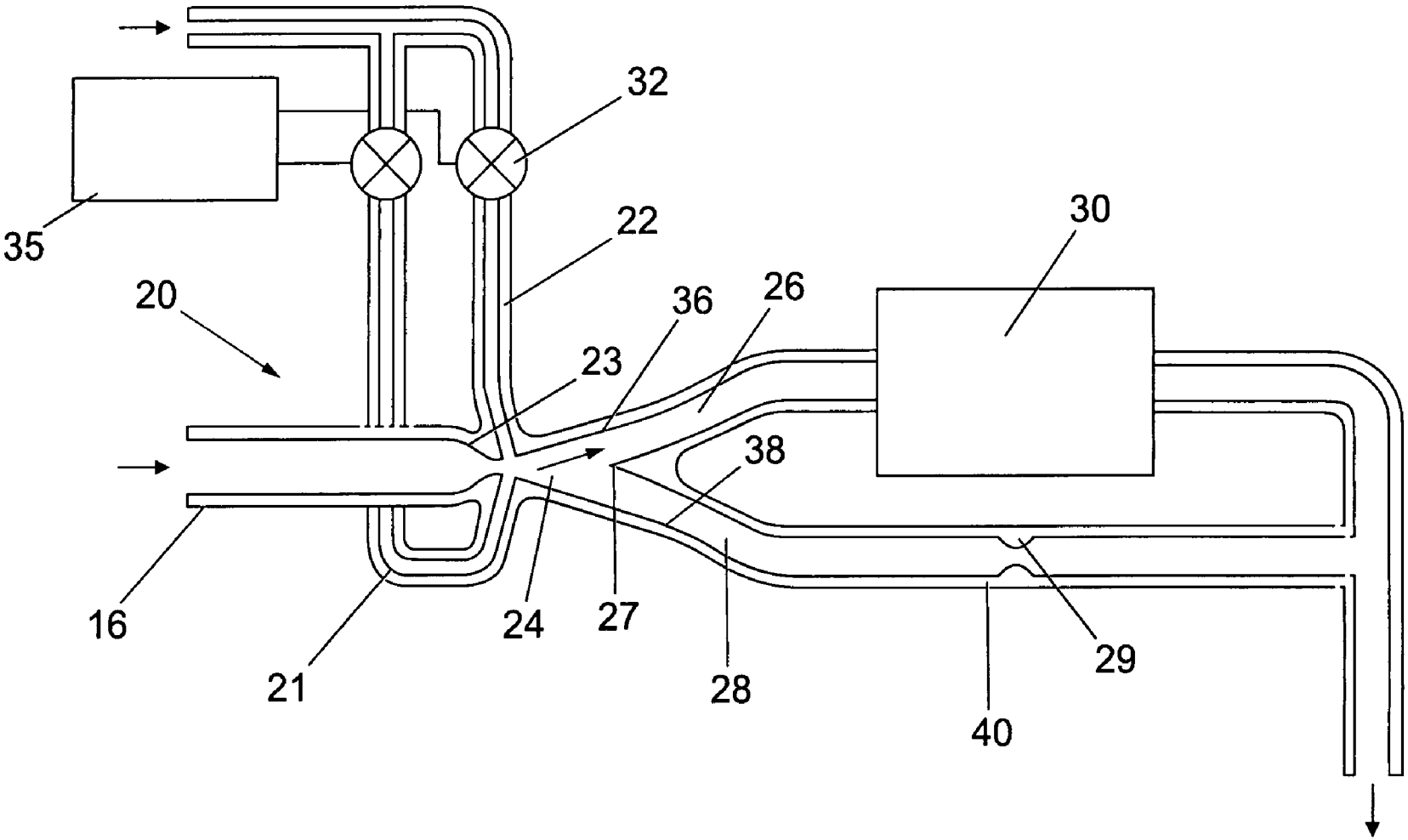
FIG. 2 is a schematic view of a diverter in accordance with the present invention along with attached components.

One embodiment of the fluidic diverter 20 is shown in FIG. 2. The diverter 20 comprises a constriction or nozzle 23 immediately followed by an expansion space 24. The expansion space 24 has two outlets 26, 28 and a first 21 and second 22 control line. The outlet 26 connects to the exhaust gas recirculation cooler 30 and the outlet 28 connects to the bypass 40. In this embodiment, the outlets 26, 28 are symmetrical around a center line parallel with the direction of the exhaust gas flowing into the diverter 20. An apex 27 separates the outlets 26, 28.

The control lines 21, 22 are provided at opposite sides of the expansion space 24 and are oriented to direct air at almost 90° to the direction of the exhaust gas proceeding through the exhaust gas line 16, nozzle 23 and expansion space 24. Through appropriate geometric selection of the nozzle 23, expansion space 24, and outlets 26, 28 and the differential pressurization of the control ports 21, 22, the Coanda effect can be utilized to divert the exhaust gas flow from one outlet 26, 28 to the other, as required and as described in more detail below.

Air from the turbocharger is supplied to the control lines 21, 22 which are each provided with a solenoid valve 31, 32 respectively. Alternatively another source of compressed air may be used, for example from an air compressor (not shown). An electronic controller 35 controls the valves 31, 32.

The exhaust gas recirculation cooler 30 comprises a liquid coolant inlet 33, liquid coolant outlet 34 and liquid coolant flow passages (not shown) which serve to cool the air in the recirculated exhaust gas before it proceeds to the engine intake.

An obstruction 29 is placed in the bypass line 40 in order to balance the downstream pressure drop caused by the exhaust gas recirculation cooler 30 so that this pressure drop does not affect the direction of flow of the exhaust gas through the diverter 20.

Alternatively, the bypass line 40 may be sized in order to balance the downstream pressure drop in the bypass 40 with that caused by the exhaust gas recirculation cooler 30.

Thus in use, exhaust gas is emitted from the engine exhaust 12, a portion proceeds through the exhaust line 16 and into the diverter 20, FIG. 2. The flow is constrained into a narrow stream by the nozzle 23 and then emitted into the expansion space 24. In the absence of the control lines 21, 22 the air would be directed onto the apex 27 separating the outlets 26, 28.

A pulse of excess pressure is emitted from, for example, the control line 21 by appropriate adjustment of the corresponding valve 31. The pulse of air directs the exhaust stream towards the side 36 of the outlet 26. Due to the presence of the Coanda effect, the exhaust stream will adhere to and continue to flow along the side 36 and proceed through the outlet 26 to the exhaust gas recirculation cooler 30 even after the pulse of air has been emitted and no more air flows out of the control line 21. It is noted that the side 36 curves away from the outlet 26 and is not straight—this is preferable but not essential.

When it is required to bypass the exhaust gas recirculation cooler 30, a pulse of air is emitted by the valve 32 on the opposite side of the exhaust gas stream, causing the exhaust gas stream to move to the side 38 of the outlet 28 and proceed through the connected bypass 40. Also due to the Coanda effect, the exhaust gas stream will continue to flow alongside the side 38 and through the connected bypass 40 until a further pulse of air from the control line 21 is emitted to direct it through the exhaust gas recirculation cooler 30. The side 38 also curves away from the opposite outlet, that is, it curves away from the outlet 26.

Thus embodiments of the invention allow for the exhaust gas stream to be directed through the primary heat transfer portion of the exhaust gas recirculation cooler or bypass without coming into direct contact with valves.

Thus an optimal temperature between fully cooled and completely uncooled for the exhaust gas for any given operating condition can be obtained. To achieve this the exhaust gas is rapidly directed from one outlet to the other (i.e. between the cooling outlet 26 and bypass outlet 28) and the relative amount of time the flow is routed along each of these outlets is varied accordingly.

Although the embodiment described herein describes the fluidic diverter in use with a separate exhaust gas recirculation cooler and bypass, diverters in accordance with the present invention can also be utilized to direct exhaust gas through a portion of the exhaust gas recirculation cooler where minimal cooling occurs rather than a separate bypass.

Diverters in accordance with the present invention can be constructed from a wide variety of materials including but not limited to steel, stainless steel and inconel thus allowing its characteristics to be tailored for high-temperature use and corrosion resistance.

Embodiments of the present invention benefit in that they have very few moving parts, none of which are directly in the exhaust gas stream, thus they are not susceptible to plugging or sticking due to soot, other contaminants in the exhaust gas or the extreme conditions of the exhaust gas. Moreover, for certain embodiments the low number of parts and simplicity of operation allow for a potentially low cost because the valves 31, 32 do not need to be of such a high specification as valves provided in the exhaust gas stream.

In an alternative embodiment, outlets are arranged asymmetrically around the direction of the exhaust gas flowing through the line 16. Thus in the absence of interference from control ports, the flow will lead to a first outlet either the outlet leading to the primary heat transfer portion of the exhaust gas recirculation cooler, or the outlet connected to the bypass line, depending on the application requirements. In order to change the direction of the exhaust gas flow to the second outlet, air is released from a control port to direct the flow to the second outlet. Alternatively, or jointly, a second opposite control port on the outlet side opposite that preferred by the flow is connected to a source of negative pressure which also serves to direct the flow to the second outlet. On cessation of gas emitted by the control line (or the negative pressure) the exhaust gas flow will revert to its biased flow path, proceeding through the first outlet.

In a modified embodiment, the solenoid valves are replaced by a fluidic signal that is created by the temperature of the exhaust gas or by a fluidic equivalent of a thermocouple.

Improvements and modifications may be made without departing from the scope of the invention.

We claim:

1. A diverter for an exhaust gas recirculation loop, the diverter comprising a flow passage and at least one control line, the flow passage comprising:

an exhaust gas inlet connectable to an exhaust gas outlet of an engine;

a first outlet connectable to a cooling portion of an exhaust gas recirculation cooler;

a second outlet connectable to a bypass around said cooling portion of an exhaust gas recirculation cooler; and, an expansion space;

wherein the at least one control line is adapted for fluid communication with the flow passage in order to selectively direct a higher proportion of exhaust gas into one of the said two outlets.

2. A diverter as claimed in claim 1, wherein the control line is adapted to selectively cause substantially all of the exhaust gas to proceed through one of the said two outlets and not through the other.

3. A diverter as claimed in claim 1, wherein the flow passage comprises a constriction upstream of the expansion space.

4. A diverter as claimed in claim 1, wherein the angle between the main axis of the first outlet and the main axis of the second outlet is less than 90°.

5. An exhaust gas recirculation cooler and bypass apparatus comprising:

an exhaust gas recirculation cooler having a cooling portion;

a bypass around said cooling portion of the exhaust gas recirculation cooler;

a diverter comprising a flow passage and at least one control line;

said flow passage comprising an exhaust gas inlet and an expansion space, the flow passage communicating with the said cooling portion and said bypass, wherein the at least one control line is adapted for fluid communication with the flow passage in order to selectively direct a higher proportion of the exhaust gas to one of the said cooling portion and bypass.

6. Apparatus as claimed in claim 5, comprising a turbocharger in gaseous communication with the at least one control line.

7. Apparatus as claimed in claim 5, wherein the cooling portion of the exhaust gas recirculation cooler is adapted to cool the exhaust gas by use of a liquid coolant.

8. Apparatus as claimed in claim 5, wherein the bypass comprises a restriction adapted to equalize the flow rate through the bypass with the flow rate through the cooling portion of the exhaust gas recirculation cooler.

9. An exhaust gas recirculation loop comprising the apparatus as claimed in claim 5 and an engine, said cooling portion and bypass each having an outlet; wherein the exhaust gas inlet of the said flow passage is connected to an exhaust gas outlet of said engine and the outlets of the cooling portion and bypass are connected to an air inlet of the engine.

10. A method of bypassing an exhaust gas recirculation cooler, the method comprising:

(a) providing a diverter comprising a flow passage and at least one control line, the flow passage comprising:

an exhaust gas inlet connected to an exhaust gas outlet of an engine;

a first outlet connected to a cooling portion of an exhaust gas recirculation cooler;

a second outlet connected to a bypass around said cooling portion of an exhaust gas recirculation cooler; and, an expansion space;

the at least one control line being adapted for fluid communication with the flow passage;

(b) directing exhaust gas through the flow passage of the diverter and actuating the control line to selectively direct a higher proportion of exhaust gas into one of the said two outlets.

11. A method as claimed in claim 10, wherein the cooling portion and bypass around said cooling portion each have an outlet which is connected to an air inlet of an engine in order to cool the air prior to the air being fed into the engine.

* * * * *